US010704349B2

(12) United States Patent
Salvador

(10) Patent No.: US 10,704,349 B2
(45) Date of Patent: Jul. 7, 2020

(54) CORE BARREL HEAD ASSEMBLY AND METHOD

(71) Applicant: EPIROC CANADA INC., Mississauga, Ontario (CA)

(72) Inventor: Patrick Salvador, North Bay (CA)

(73) Assignee: EPIROC CANADA INC., Mississauga, Ontario (CA)

( * ) Notice: Subject to any disclaimer, the term of this patent is extended or adjusted under 35 U.S.C. 154(b) by 193 days.

(21) Appl. No.: 15/580,202

(22) PCT Filed: May 27, 2016

(86) PCT No.: PCT/CA2016/050601

§ 371 (c)(1),
(2) Date: Dec. 6, 2017

(87) PCT Pub. No.: WO2016/205927

PCT Pub. Date: Dec. 29, 2016

(65) Prior Publication Data

US 2018/0171735 A1 Jun. 21, 2018

Related U.S. Application Data

(60) Provisional application No. 62/183,852, filed on Jun. 24, 2015.

(51) Int. Cl.

| | |
|---|---|
| ***E21B 25/02*** | (2006.01) |
| ***E21B 31/18*** | (2006.01) |
| ***E21B 31/20*** | (2006.01) |

(52) U.S. Cl.

CPC ..... *E21B 25/02* (2013.01); *E21B 31/18* (2013.01); *E21B 31/20* (2013.01)

(58) Field of Classification Search

CPC ..... E21B 25/02; E21B 31/18; E21B 31/20
See application file for complete search history.

(56) References Cited

U.S. PATENT DOCUMENTS

| | | | |
|---|---|---|---|
| 3,333,647 | A | 8/1967 | Karich et al. |
| 3,738,435 | A | 6/1973 | Bronson |

(Continued)

FOREIGN PATENT DOCUMENTS

| | | | |
|---|---|---|---|
| EP | 2264277 | B1 | 8/2012 |
| GB | 1478127 | A | 6/1977 |

(Continued)

OTHER PUBLICATIONS

Extended European Search Report dated Oct. 26, 2018 in corresponding European application No. 16813422.9 (8 pages).

(Continued)

*Primary Examiner* — David J Bagnell
*Assistant Examiner* — Yanick A Akaragwe
(74) *Attorney, Agent, or Firm* — Venable LLP; Jeffri A. Kaminski

(57) ABSTRACT

A core barrel head assembly including an upper body comprising a central passage. A pair of latches is arranged in the central passage. Each latch pivots about a pivot point at a first end. Each latch includes a latch release at a second end and an outer tube surface engaging surface between the first end and the second end. A retracting case includes a first end configured to engage at least the latch release of the latches. The outer tube surface engaging surface of each latch extends through a latch slot in an outer wall of the upper body and such that the latches rotate about the pivot point. The latches are movable between an extended position and retracted position by the retracting case with a mechanical advantage.

18 Claims, 16 Drawing Sheets

(56) References Cited

U.S. PATENT DOCUMENTS

| | | | | |
|---|---|---|---|---|
| 4,834,198 | A | 5/1989 | Thompson | |
| 5,267,620 | A | 12/1993 | Lee | |
| 5,325,930 | A | 7/1994 | Harrison | |
| 5,934,393 | A | 8/1999 | Marshall | |
| 6,425,449 | B1 | 7/2002 | Marshall | |
| 9,488,022 | B2 * | 11/2016 | Alix | E21B 31/18 |
| 2007/0039761 | A1 | 2/2007 | Cruz | |
| 2011/0100719 | A1 | 5/2011 | Mildren et al. | |
| 2014/0353039 | A1 | 12/2014 | Lambert et al. | |

FOREIGN PATENT DOCUMENTS

| | | | |
|---|---|---|---|
| RU | 2487986 | C2 | 7/2013 |
| SU | 791927 | A1 | 12/1980 |
| SU | 1740619 | A1 | 6/1992 |
| WO | 01/21930 | A1 | 3/2001 |
| WO | 2008/109522 | A1 | 9/2008 |
| WO | 2010/071563 | A1 | 6/2010 |
| WO | 2012/068662 | A1 | 5/2012 |
| WO | 2012/068674 | A1 | 5/2012 |
| WO | 2015/059341 | A1 | 4/2015 |

OTHER PUBLICATIONS

International Search Report dated Aug. 30, 2016, in corresponding International Application No. PCT/CA2016/050601 (4 pages).
Russian Office Action in corresponding Russian Application No. 2018102522 dated Oct. 21, 2019 (9 pages).
Decision of Grant issued by Russian Patent Office in corresponding Russian Application No. 2018102522 dated Feb. 3, 2020 (6 pages).

* cited by examiner

CORE BARREL HEAD ASSEMBLY AND METHOD

RELATED APPLICATIONS

The present application is a National Phase of International Application No. PCT/CA2016/050601, filed May 27, 2016, and claims priority to provisional U.S. Patent Application No. 62/183,852, filed Jun. 24, 2015; each of which is incorporated by reference in its entirety.

FIELD OF THE INVENTION

The invention relates drilling assemblies for earth drilling. In particular, the invention relates to core barrel head assemblies and overshot devices.

BACKGROUND OF THE INVENTION

In the course of exploratory drilling of the earth, rock samples are often collected to investigate subsurface composition and characteristics. The samples may be collected from various depths of from hundreds to thousands of meters. Such samples are typically collected utilizing core barrel assemblies that include double core tubes having an inner core tube and an outer core tube. While the outer tube may extend through substantially the entire hole, the inner tube may be relatively short, such as on the order of a few meters. The sample is typically collected in the inner tube, which may have a length of a few meters.

In preparation for drilling, an inner tube is inserted into the outer tube until it reaches the bottom of the outer tube so that drilling can begin. A drilling fluid, such as water, used to flush drilling debris from the hole and the tubes may be utilized to exert a force to advance the inner tube through the outer tube. When the inner tube has reached the correct position, a latching mechanism immobilizes the inner tube with respect to the outer tube.

When the inner tube contains the desired sample, the inner tube and sample may then be removed from the hole by attaching a retrieval mechanism to an end of the inner tube assembly. The retrieval mechanism may be suspended on a wire and lowered into the drill string to retrieve the inner tube with the sample. Such an assembly is known as a wireline system. The retrieval mechanism engages an attachment mechanism on the inner tube. The retrieval mechanism then withdraws the inner tube and the sample from the outer tube.

The retrieval mechanism, typically known as an overshot, includes a gripping structure to grip the inner tube. The gripping structure typically includes a claw or "spearhead" to engage a gripping structure in or on the upper end of inner tube of the core barrel. The structure on the inner tube is typically referred to as the head assembly.

To remove the overshot and inner tube containing the sample, force is applied to the wire to pull on the overshot. As force is applied to the wire, the latches are retracted so as to disengage from the walls of the outer tube and the overshot, inner tube and sample are withdrawn from the hole. The overshot may also be utilized to lower a new inner tube into the hole.

A core barrel head and overshot may be utilized when drilling above or below ground. In an underground application, the hole may extend in an upward direction. When exploration and ore definition drilling are carried out in such a context, the core barrel head and overshot typically include at least one sealing member that may be propelled through the drill string with pressurized fluid.

A number of problems may occur with existing designs of core barrel assemblies and overshot assemblies. For example, if the ground formation breaks or fractures, the broken rock may cause the inner tube to become stuck in the outer tube. Typically, freeing the inner tube involves increasing a withdrawing force on the wire. This may cause the wire to break or the hoist to stall. As a result, the entire drill string may need to be removed from the hole to clear the stuck inner tube and make it possible to continued drilling.

To address this problem, the latches have been modified to have a mechanical advantage to unlatch the latches when pulling on the wire line. However, the increased force on the latches may cause the latch linkage system to quickly wear out, resulting in failure of parts. Alternatively, the linkage system will over travel and lock the latches engaged with the outer tube. Additionally, to facilitate the latch linkage, the latches may be made thinner. Reducing the thickness of the latches weakens them, making them prone to break during handling outside of the drill string.

A further problem with known designs of core barrel assemblies is that latches and components may be attached using spring pins. These pins may lose their plasticity over time and may eventually fall out of the assembly unnoticed. Such assemblies can be complex and time consuming to rebuild. Not only does it take time and money to make repairs, but any time a drilling assembly is not in use may result in lost revenues.

Some problems with existing core barrel designs relate to modifications to assist the functioning. For example, to ensure the head assembly turns with the drill string, the outer tube locking surface may include a protrusion to interact with the latches. If the head assembly lands with the latches aligned with the protrusion, the latches will not engage properly. If drilling were to begin in this configuration, the core would not enter the inner tube. This typically results in aborting the drilling of the hole because the inner tube will not be able to capture the suspended core.

Other problems do not relate to the actual latches but rather to other elements. For example, fluid pressure may be utilized to propel the inner tube assembly. To make this possible, sealing devices must be installed on the head assembly. Typically, such sealing devices are installed on the latch retracting unit with a secondary valve. This may increase the number of parts, complexity, and length of the head assembly. If the drilled hole reaches an underground water reservoir, the pressure of the released water can act on the reverse side of the seals activating the latch retracting unit of the head assembly, thereby causing it to disengage with the outer tube and exit the drill string uncontrolled. One solution is this problem is to have a replaceable or permanent assembly between the upper and lower bodies of the head assembly to hold the seals. However, including such an assembly increases the length and requires different parts for the outer tube.

As described above, a core barrel may be utilized to drill in an upward direction. Known head assembly designs typically include a latch locking system to prevent the core barrel head from accidentally disengaging the locking coupling. The locking system typically must be disengaged in order for the operator to insert the latch portion of the head assembly inside the drill string. To disengage the locking system, a short tubular part may be utilized to hold the latches disengaged while the inner tube assembly is pushed into the drill string. The short tubular part slides off of the head assembly when the head assembly is inserted. The short tubular part then falls to the ground. Alternatively, a latch locked head assembly may be inserted by pulling and holding the retracting case in an unlatched position while pushing in the inner tube assembly using only the small spear head. This becomes increasingly difficult the closer a hole is to vertical.

Some problems with existing designs relate to the connection between the overshot and the core barrel assembly. For example, the overshot used to retrieve the inner tube assembly typically includes spring loaded lifting dogs to connect with the head assembly. When the head assembly is lifted out of the drill string, it is often above the operators' heads and is a falling hazard. If the lifting dogs accidentally hit a protrusion on the drill's mast, the overshot can release the inner tube assembly causing injury to the operators.

One method to lock the overshot engaged requires the use of a manually operated lock. Often, it is forgotten to engage the lock. Additionally, the drilling process must be paused to engage the lock, thereby reducing productivity.

Another method to lock the lifting dogs is to nest them within the body of the overshot while the overshot carries the weight of the inner tube. This configuration results in the need to lift the weight of the inner tube in order to disengage the lock. Locking dogs may also be used to prevent the lifting dogs from moving once the lifting dogs are engaged with the head assembly. The locking dogs may be activated by the spearhead entering the overshot body, but it is often engaged prematurely when the over shot is lowered and enters the water remaining in the drill string. This causes the overshot to be locked before reaching the head assembly and locking out the spear head.

Other issues exist relating to the interaction between the latches and the overshot. For example, the gripper on the head assembly to connect with the overshot may include a spearhead point 101 on the top end of the head assembly. If a hole is being drilled upwardly, the spearhead is pointed down toward the operators. If fluid pressure is lost while the inner tube assembly is being pumped through the drill string, gravity will accelerate the inner tube assembly to drop out of the hole toward the operators. An inner tube assembly exiting the drill string uncontrolled can impale an operator causing injury or death.

To address this situation, the spearhead point has been made flexible to ease its handling on the surface. However, the flexible joint often fails to hold the point centered in the drill string, thereby causing the overshot to miss and not engage. Once this happens, rods must be removed to retrieve the inner tube assembly and continue drilling.

SUMMARY OF THE INVENTION

Embodiments of the invention include a core barrel head assembly including an upper body comprising a central passage. A pair of latches is arranged in the central passage. Each latch pivots about a pivot point at a first end. Each latch includes a latch release at a second end and an outer tube surface engaging surface between the first end and the second end. A retracting case includes a first end configured to engage at least the latch release of the latches. The outer tube surface engaging surface of each latch extends through a latch slot in an outer wall of the upper body and such that the latches rotate about the pivot point. The latches are movable between an extended position and retracted position by the retracting case with a mechanical advantage.

Additionally, embodiments of the invention include an overshot for retrieving a core barrel inner tube assembly from a drill string. The overshot includes lifting arms configured to move between an engaged position in which the lifting arms engage the core barrel head assembly and a disengaged position in which the lifting arms a disengaged from the core barrel head assembly. Release arms are configured to move the lifting arms between the engaged position and the disengaged position. A locking arm is configured to lock the release arms in the from moving the lifting arms into a release position.

Furthermore, embodiments of the invention include a method in earth drilling. The method includes providing a core head barrel including an upper body including a central passage; a pair of latches arranged in the central passage, each latch pivoting about a pivot point at a first end, and each latch including a latch release at a second end and an outer tube surface engaging surface between the first end and the second end; and a retracting case including a first end configured to engage at least the latch release of the latches, wherein the outer tube surface engaging surface of each latch extends through a latch slot in an outer wall of the upper body and such that the latches rotate about the pivot point, and wherein the latches are movable between an extended position and retracted position by the retracting case with a mechanical advantage. The core barrel head assembly is engaged with an overshot. The core barrel head assembly is removed from a hole.

Still other objects and advantages of the present invention will become readily apparent by those skilled in the art from the following detailed description, wherein is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF EMBODIMENTS OF THE INVENTION

Embodiments of the core barrel and overshot may address one or more of the shortcomings described above with known designs. Embodiments of the core barrel and/or overshot may include one or more of the features described herein. Additionally, embodiments of the core barrel may be utilized with embodiments of the overshot described herein or any other overshot. Similarly, embodiments of the overshot described herein may be utilized with embodiments of the core barrel described herein or any other core barrel.

Figure 1:
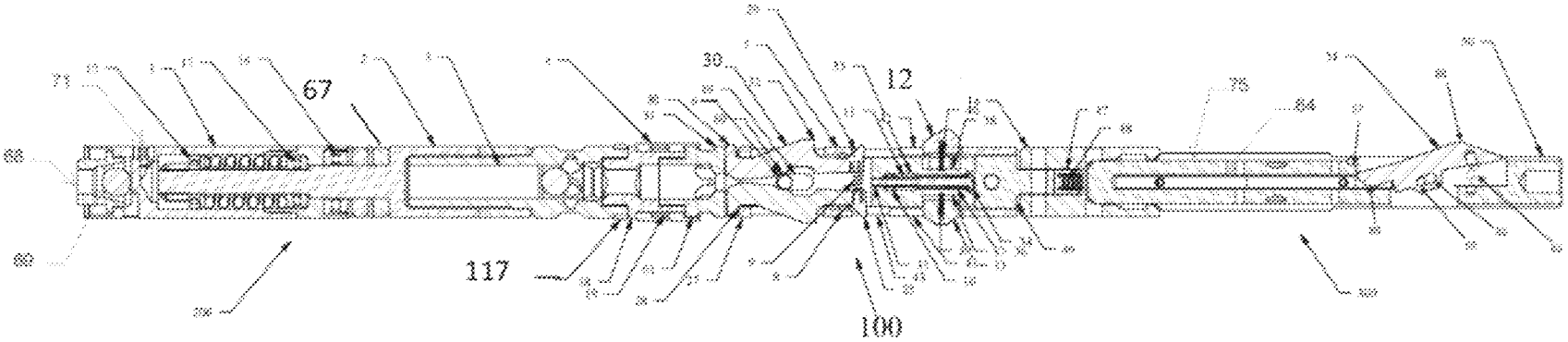
FIG. 1 represents a longitudinal cross-sectional view of an embodiment of a core barrel assembly and an overshot assembly.
Figure 2:
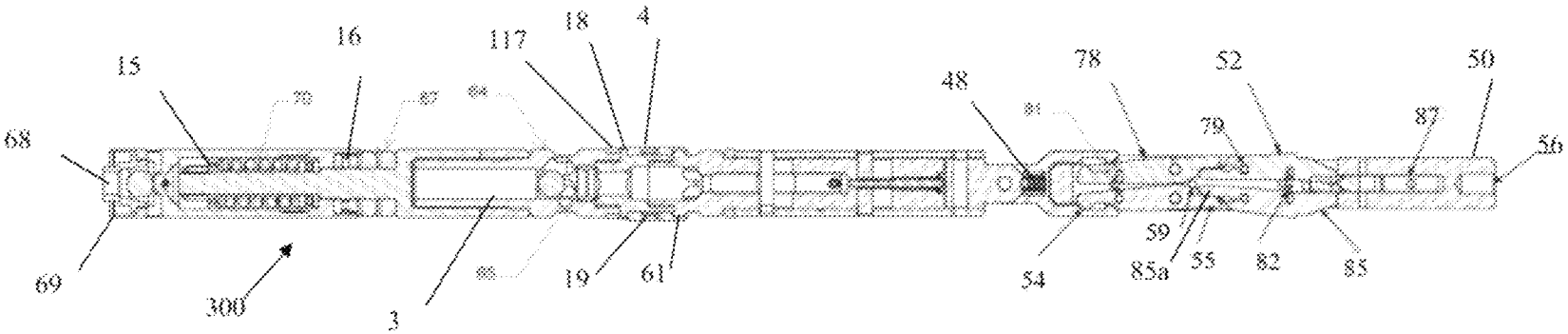
FIG. 2 represents a longitudinal cross-sectional view of the embodiment shown in FIG. 1 from a point of view perpendicular to the point of view of FIG. 1.

FIGS. 1 and 2 illustrate an embodiment of a core barrel assembly joined to an embodiment of an overshot. FIGS. 1 and 2 are cross-sectional views at about a 90° angle with respect to each other. FIG. 1 does not illustrate the outer tube to facilitate an understanding of the core barrel assembly. A core barrel assembly typically includes an upper assembly 100, a mid-body 18 or 20, a lower body 3, and a bearing assembly 200. All of the upper assembly components may be mounted on an upper body 31. The upper body components may include various elements to connect components to each other, such as threaded connections, complementarily shaped engaging ends or others.

The core barrel assembly includes at least one pair of latches 30. The latches are installed in a slot 72 in the upper body 31. The slot 72 may open through the upper body in a plurality of locations. The latches 5 may be installed through one of the openings of the slot 72. Also, one or more portions of the latches 5 may extend through the slot when the latch is extended and/or retracted.

Each latch 30 typically includes a first end 30*a* and a second end 30*b*. Each latch 30 also includes an interior surface 30*c* and an exterior surface 30*d*. The interior surface 30*c* faces the interior of the upper body 31 when installed. The exterior surface 30*d* faces away from the interior of the upper body 31 when installed. The interior surface 30*c* and exterior surface 30*d* have contours that are involved in the functioning of the latch.

For example, a hook 30*e* is arranged at or in the vicinity of the first end 30*a* of each latch 30. As shown in FIG. 1, with the latches installed in the core barrel assembly, the hook 30*e* opens toward the outside of the core barrel assembly. A pivot 28 is arranged on an outside surface of the latch in the hook 30*e*. The pivot 28 engages a bridge 27 that is a part of the upper body 31.

Figure 17:
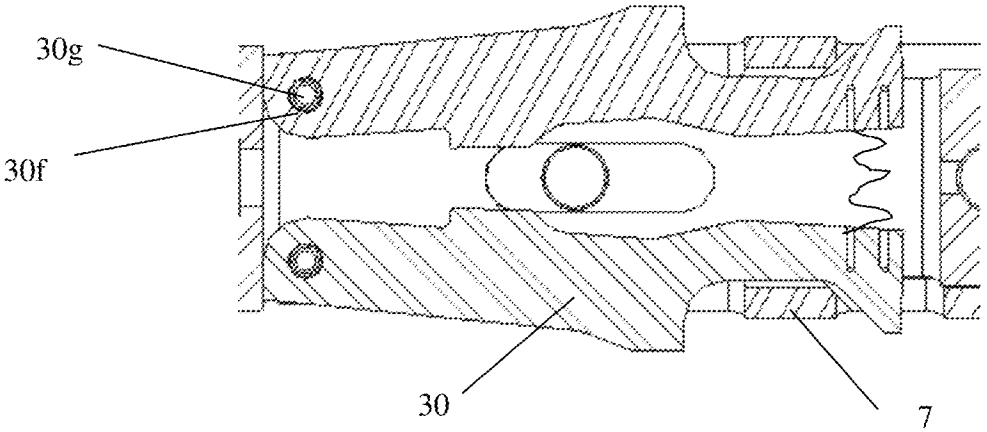
FIG. 17 represents a cross-sectional view of an embodiment of a latch assembly including a hole and pin to pivotably secure the latches.
Figure 18:
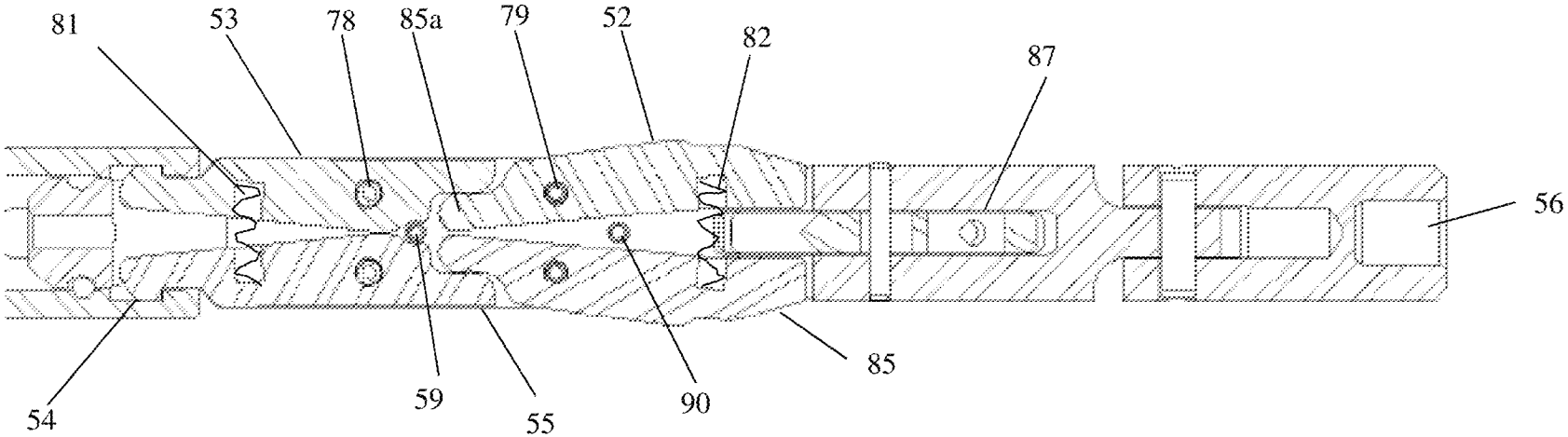
FIG. 18 represents a longitudinal cross-sectional view of an embodiment of an overshot in a locked position.
Figure 19:
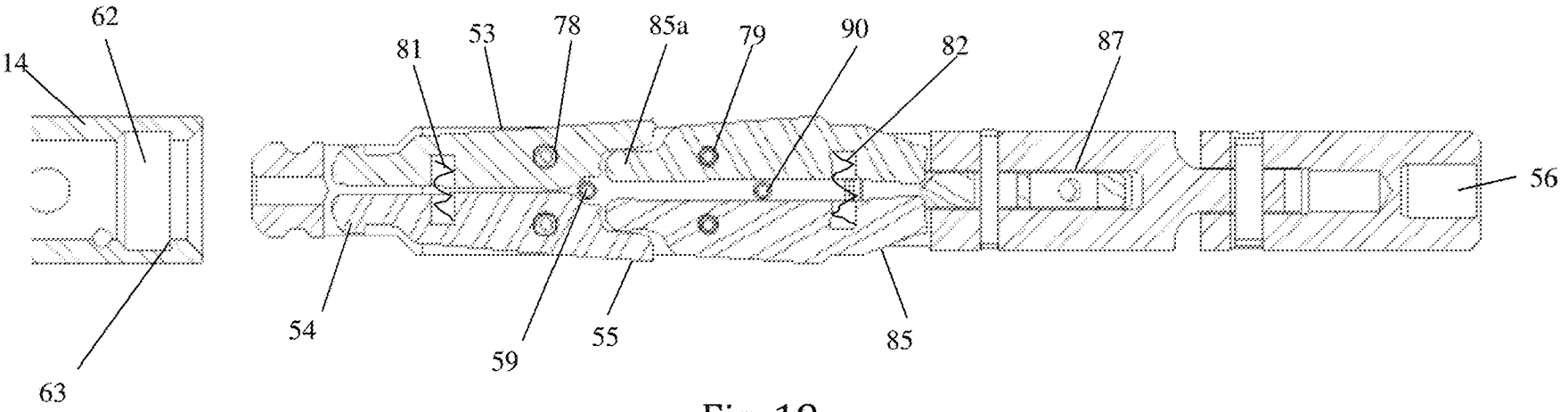
FIG. 19 represents a longitudinal cross-sectional view of the embodiment of the overshot shown in FIG. 18 in a released position.
Figure 20:
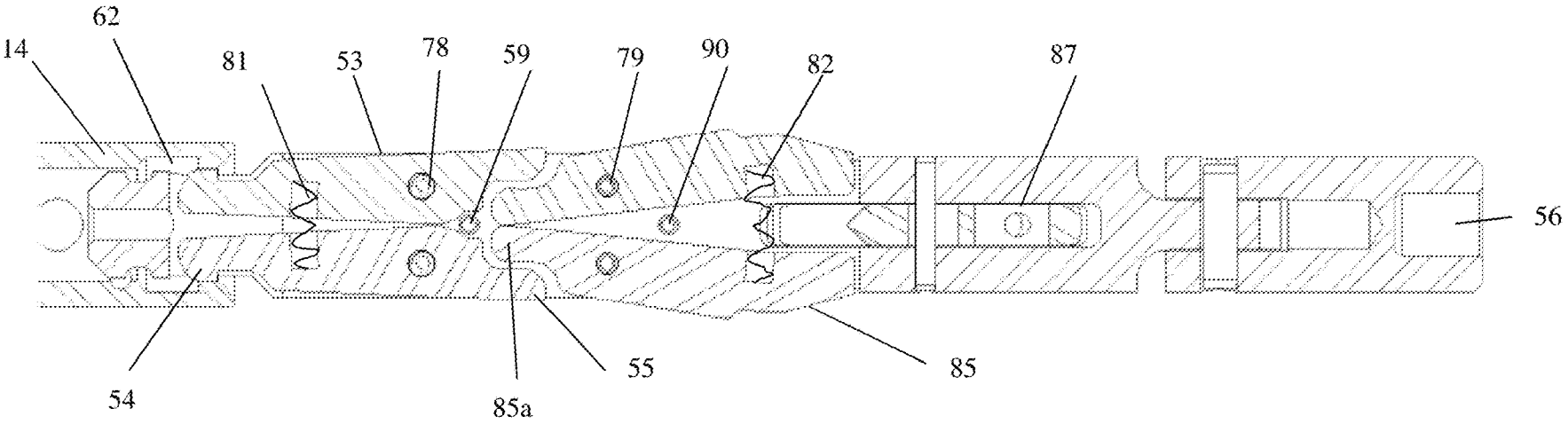
FIG. 20 represents a longitudinal cross-sectional view of the embodiment of the overshot shown in FIG. 18 in an inserting position.
Figure 21:
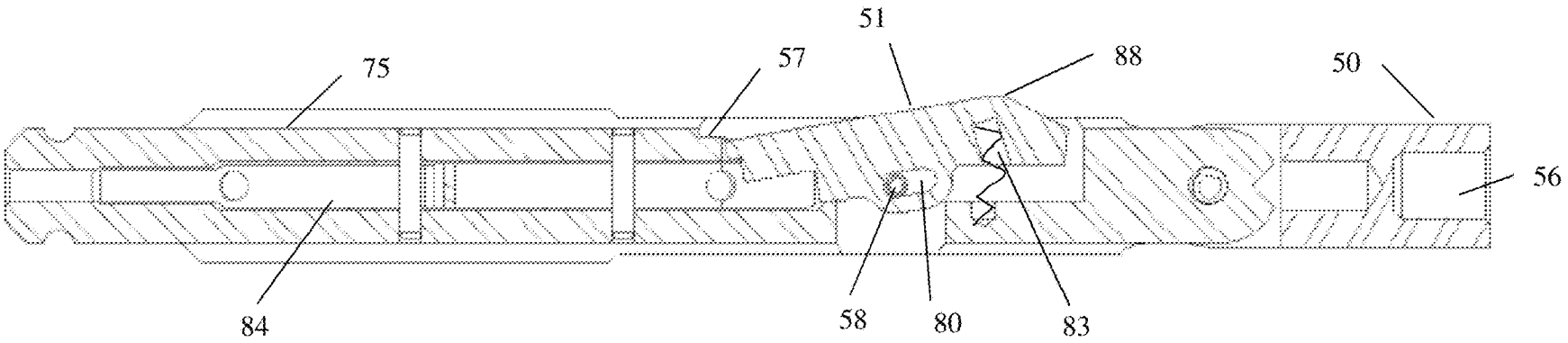
FIG. 21 represents a longitudinal cross-sectional view of the embodiment of the overshot shown in FIG. 18 in a locked position from a point of view perpendicular to the point of view shown in FIG. 18.
Figure 22:
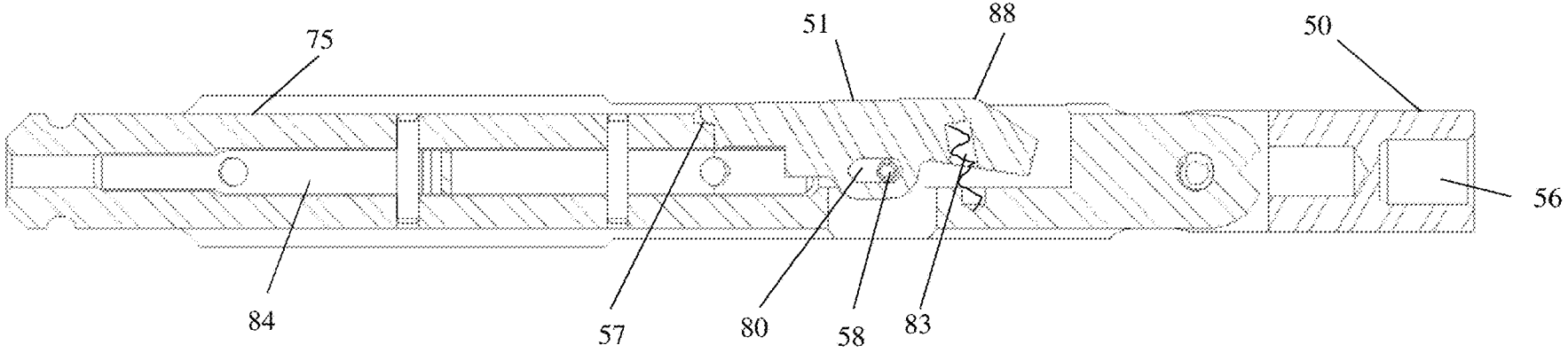
FIG. 22 represents a longitudinal cross-sectional view of the embodiment of the overshot shown in FIG. 19 in a released position from a point of view perpendicular to the point of view shown in FIG. 19.
Figure 23:
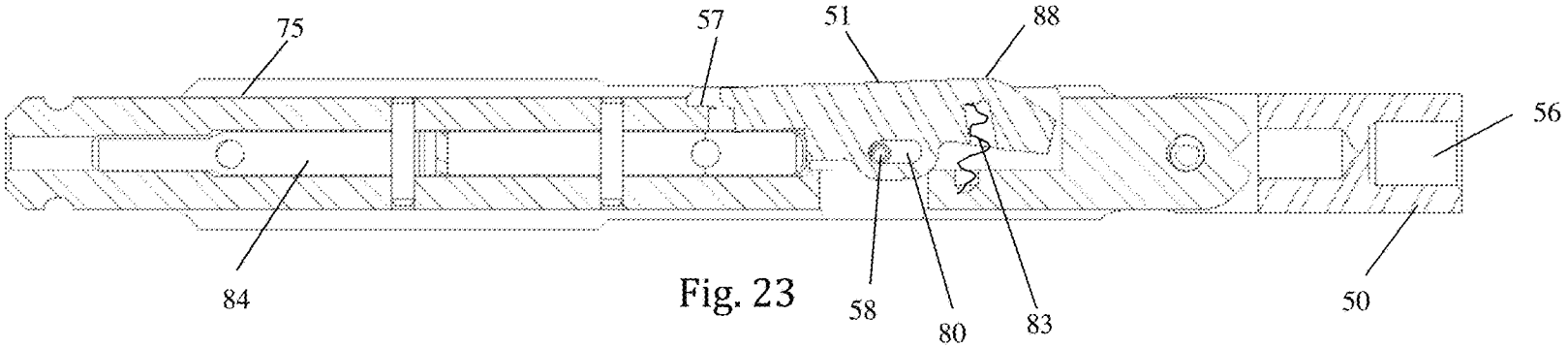
FIG. 23 represents a longitudinal cross-sectional view of the embodiment of the overshot shown in FIG. 20 in a pre-locked position from a point of view perpendicular to the point of view shown in FIG. 20.

According to an alternative embodiment, the bridge, the upper body and hook on the latch to pivotably secure the latches can be replaced with a hole 30*f* and pin 30*g*, as shown in FIG. 17.

A latch release 29 may be arranged at or in the vicinity of the second end 30*b* of each latch.

As discussed below, the contour of the latch release and interaction with the upper body 31 and retracting case 7 facilitates retraction of the latches. An outer tube engaging surface 32 is arranged between the first end and the second end of each latch 30. The outer tube engaging surface 32 engages the inner locking surface of the outer tube.

The latch release 29 typically is arranged further from the pivot 28 than the outer tube engaging surface 32. As a result, when the retracting case 7 acts on the latch release 29, the retracting case 7 will have a mechanical advantage to disengage the outer tube engaging surface.

The retracting case 7 may include a latch groove 8 that interacts with a latch release portion surface 25 to hold the head assembly in the retracted position until the force of landing knocks the latch portion 25 out of the groove 8 to permit the assembly to move to the latch engaged position.

Figure 6:
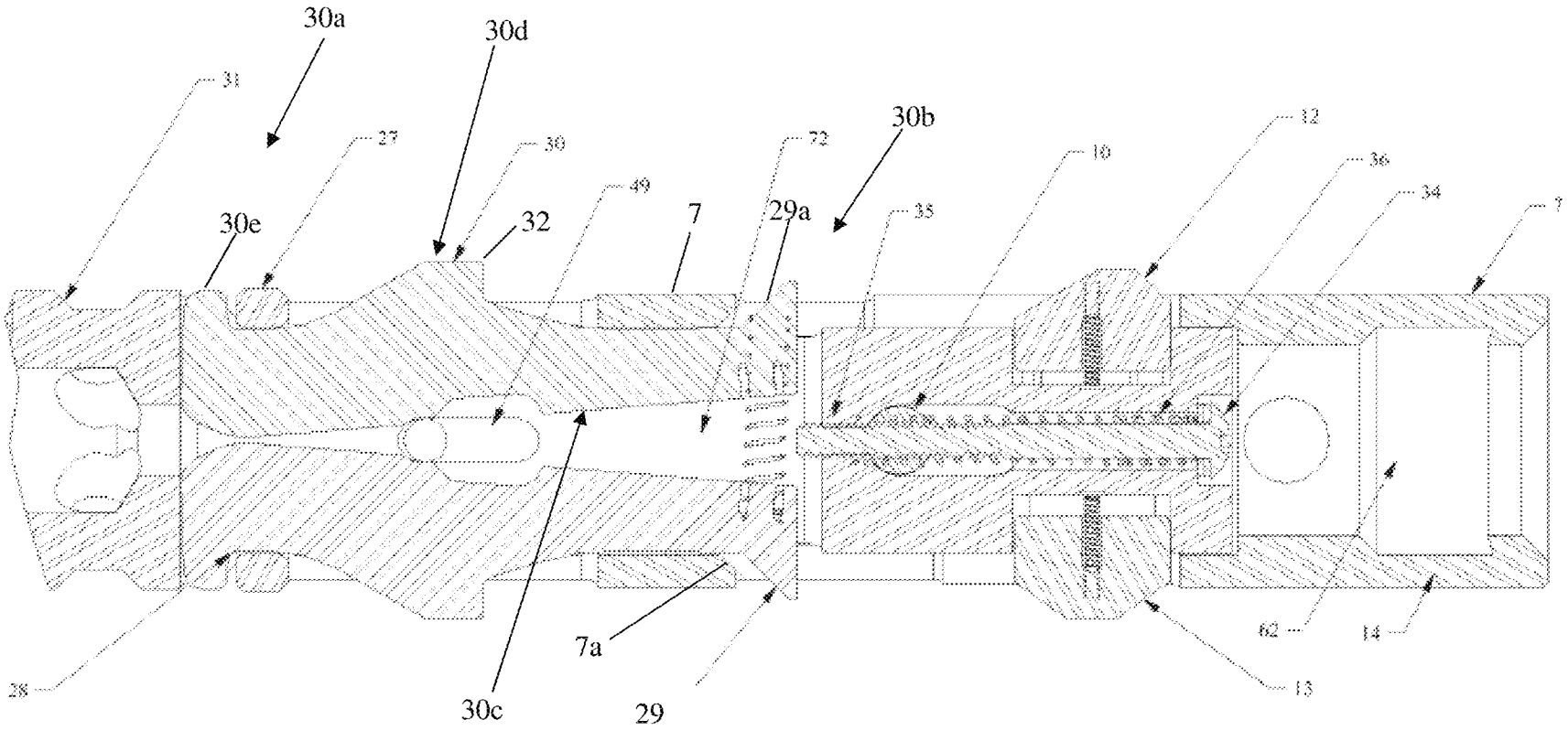
FIG. 6 represents a longitudinal cross-sectional view of the embodiment of the latch shown in FIG. 1 with the latch in an engaged position.
Figure 7:
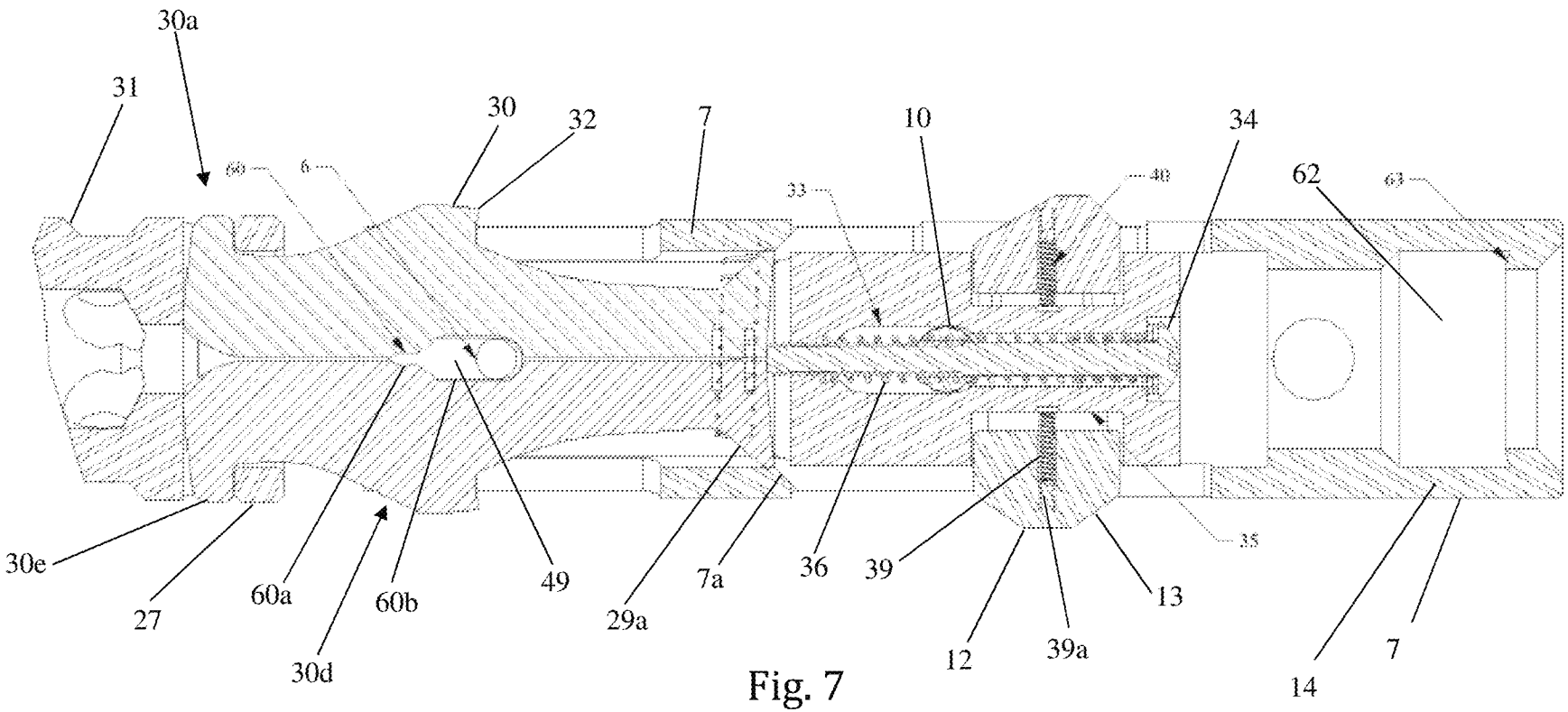
FIG. 7 represents a longitudinal cross-sectional view of the embodiment of the latch shown in FIG. 1 with the latches in a retracted position.

The inner surface of each latch may also be contoured to facilitate retraction and extension of the latches. For example, the inner surface of the latches may include a pin engaging surface 60. The pin engaging surface 60 may engage an action, or locking pin, 6 that extends through a slot 49 in the upper body 31. The pin engaging surface 60 of the latches face each other. Each pin engaging surface 60 typically includes two portions, as shown in FIGS. 6 and 7. A first portion 60*a* of the pin engaging surface 60 accommodates the locking pin between the latches with the latches in a retracted position, as shown in FIG. 7. A second portion 60*b* of the pin engaging surface 60 interacts with the locking pin 6 to force and/or maintain the latches apart when the latches are in an extended or engaged position, as shown in FIG. 6.

A spring 9 may bias the latches outward, such that the second ends of the latches are biased away from each other, as shown in FIGS. 1 and 2. Each latch may include a spring receiving passage 9*a*. The spring receiving passage 9*a* may depend upon the shape of the spring. The embodiment of the spring receiving passage 9*a* shown in FIGS. 6 and 7 is a circular ring-shaped passage. The spring receiving passage 9*a* could also be a circular cylindrical shaped passage or have any other shape that can contain at least portion of an end of the spring.

In the extended position, the release portion 29 of the latches extends out of the upper body 31, as shown in FIGS. 1 and 2. The release portion 29 of the latches may include an latch release surface 29*a*. The latch release surface may be angled inwardly with respect to the longitudinal axis of the core barrel assembly. The latch release surface 29*a* may engage a surface 7*a* of the retracting case 7 as the latches are retracted. The retracting case surface 7*a* may be angled to facilitate the movement of the latch retracting surface 29*a* past the case surface 7*a*. It may be that only one of the retracting case surface 7*a* or the latch retracting surface 29*a* is angled.

The outer tube engaging surface 32 typically extends farther from a longitudinal axis of the core barrel assembly than other portions of the outer surface of the latches with the latches in the retracted and extended positions. The outer tube engaging surface 32 has a contour and surface area to effectively engage the inner locking surface of the outer tube to immobilize the inner and outer tubes with respect to each other or reduce movement of the inner tube and outer tube to a desired degree. With the latches in a retracted position, the outer tube engaging surface 32 should be disengaged from the inner locking surface of the outer tube.

The outer surface of the latches transitions from the outer tube engaging surface 32 to the pivot and hook, pin or other structure. As shown in FIGS. 1 and 2, the outer surface of the latches between the outer tube engaging surface 32 and pivot and hook may be angled. The outer surface of the latches may have other contours.

The latches are installed in the upper assembly 100. The interior of the upper assembly 100 includes a central passage or slot 72 for receiving and housing the latches. The upper assembly 100 includes a bridge 27 that engages with the hook 30*e* and pivot 28. An opening in the side of the upper assembly receives the hook 30*e*. Another opening in the upper assembly receives the outer tube-engaging surface 32. The region of the latches between the outer tube engaging surface 32 and the retracting surface is at least partially surrounded by the retracting case 7. When the latches are installed, the latches will be completely constrained by the upper assembly.

Figure 12:
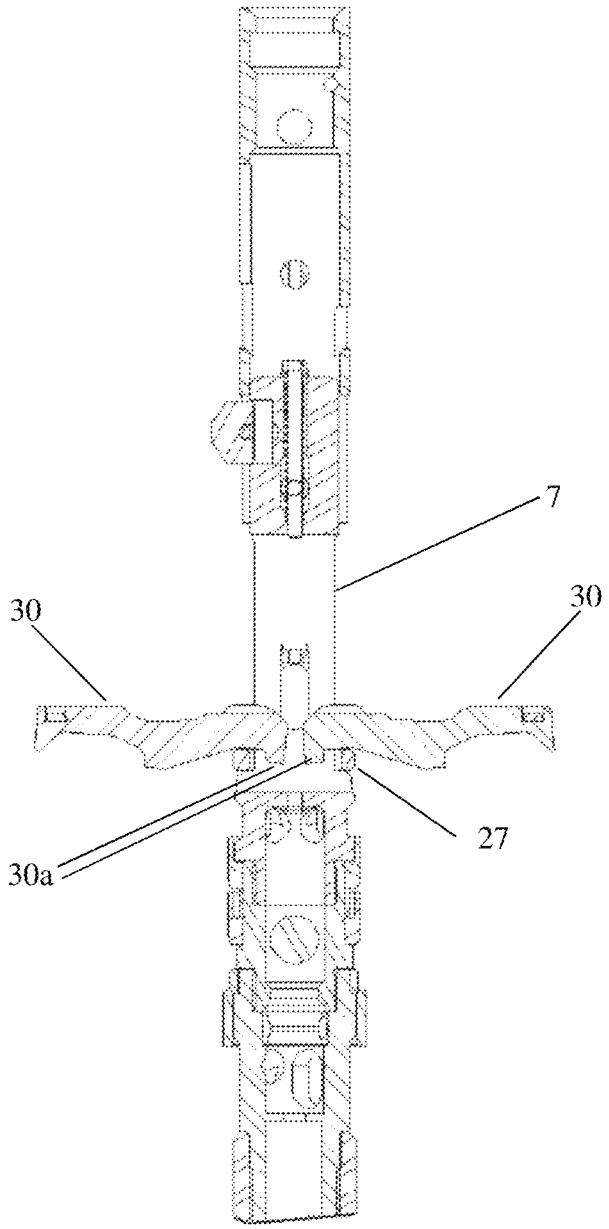
FIG. 12 represents a longitudinal cross-sectional view of the embodiment shown in FIG. 1 at the beginning of a latch installation.
Figure 13:
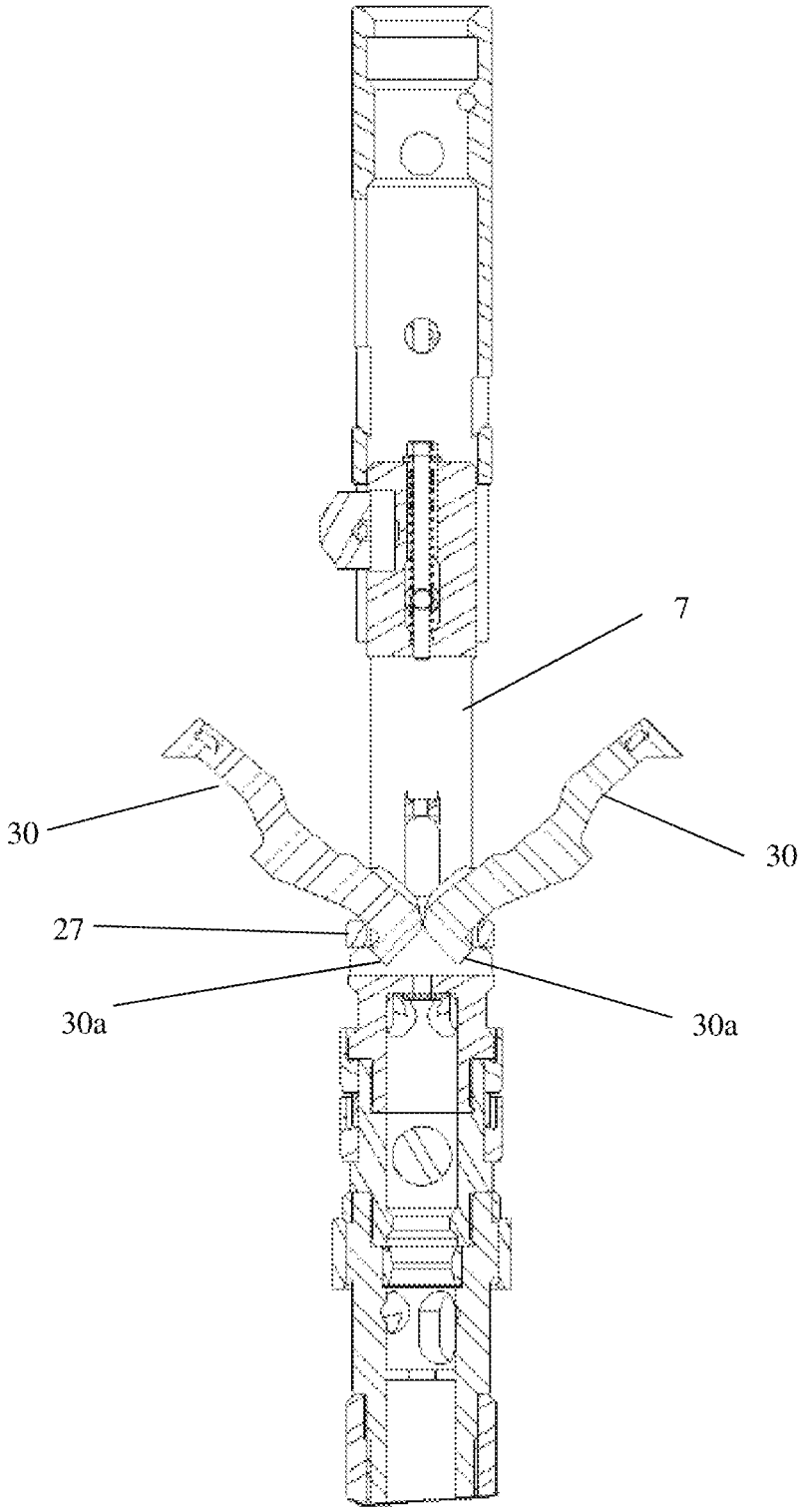
FIG. 13 represents a longitudinal cross-sectional view of the embodiment shown in FIG. 1 with the latches partially installed.
Figure 14:
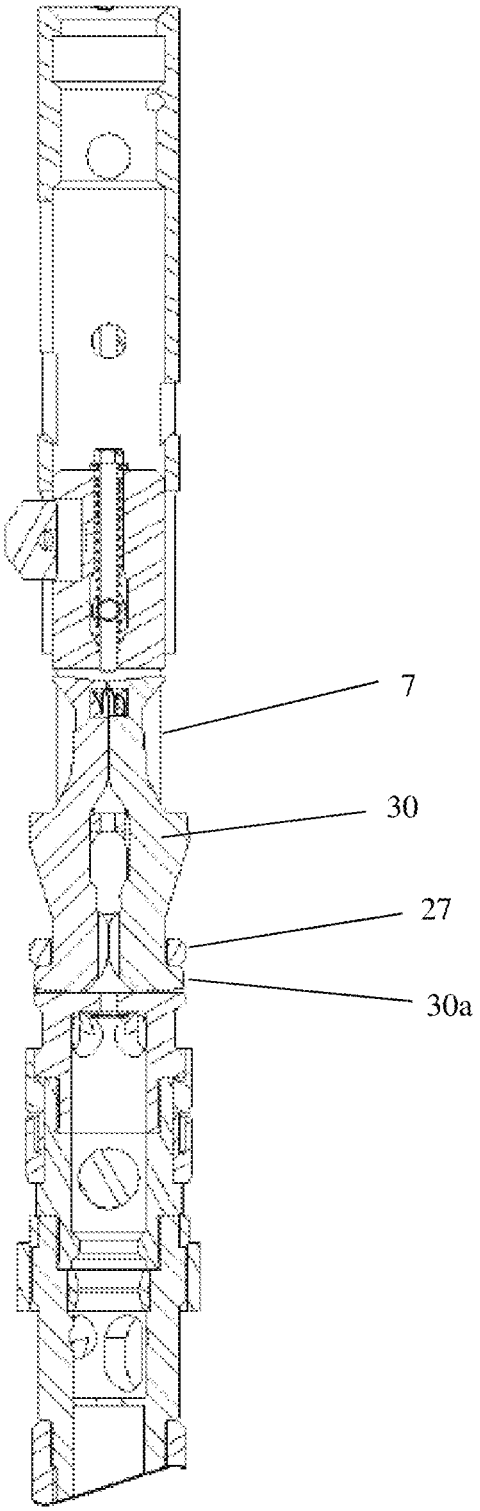
FIG. 14 represents a longitudinal cross-sectional view of the embodiment shown in FIG. 1 latch installation completed.

An embodiment of process for installation of an embodiment of the latches in an embodiment of the core barrel assembly is shown in FIGS. 12-14. As shown in FIG. 12, each latch of a pair of latches is inserted from the side of the upper body. The latches are inserted into the slot in the upper body. As shown in FIG. 12, the latches are arranged such that the hook passes around the bridge in the upper body and the pivot is arranged in the vicinity of the bridge. The latches are then rotated about the pivot and the bridge toward each other, as illustrated in FIG. 13. Rotation of the latches continues until the latches are fully inserted into the upper body as shown in FIG. 14.

Figure 15:
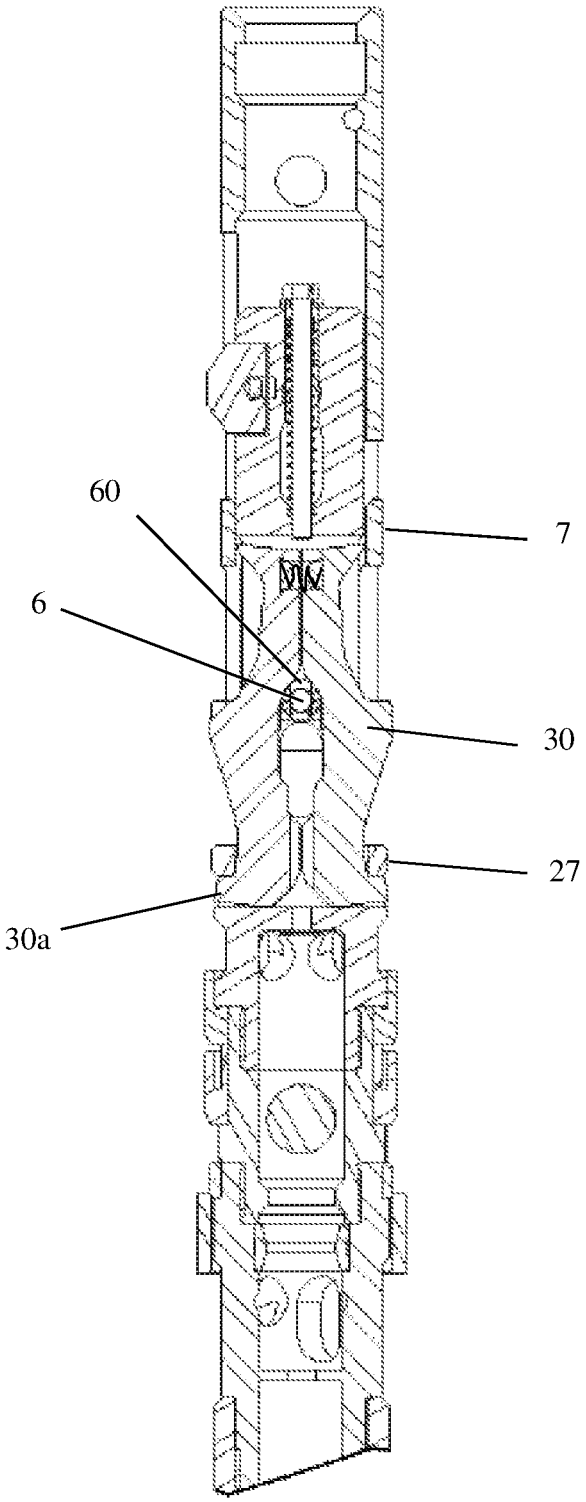
FIG. 15 represents a longitudinal cross-sectional view of the embodiment shown in FIG. 1 with the retracting case partially installed.
Figure 16:
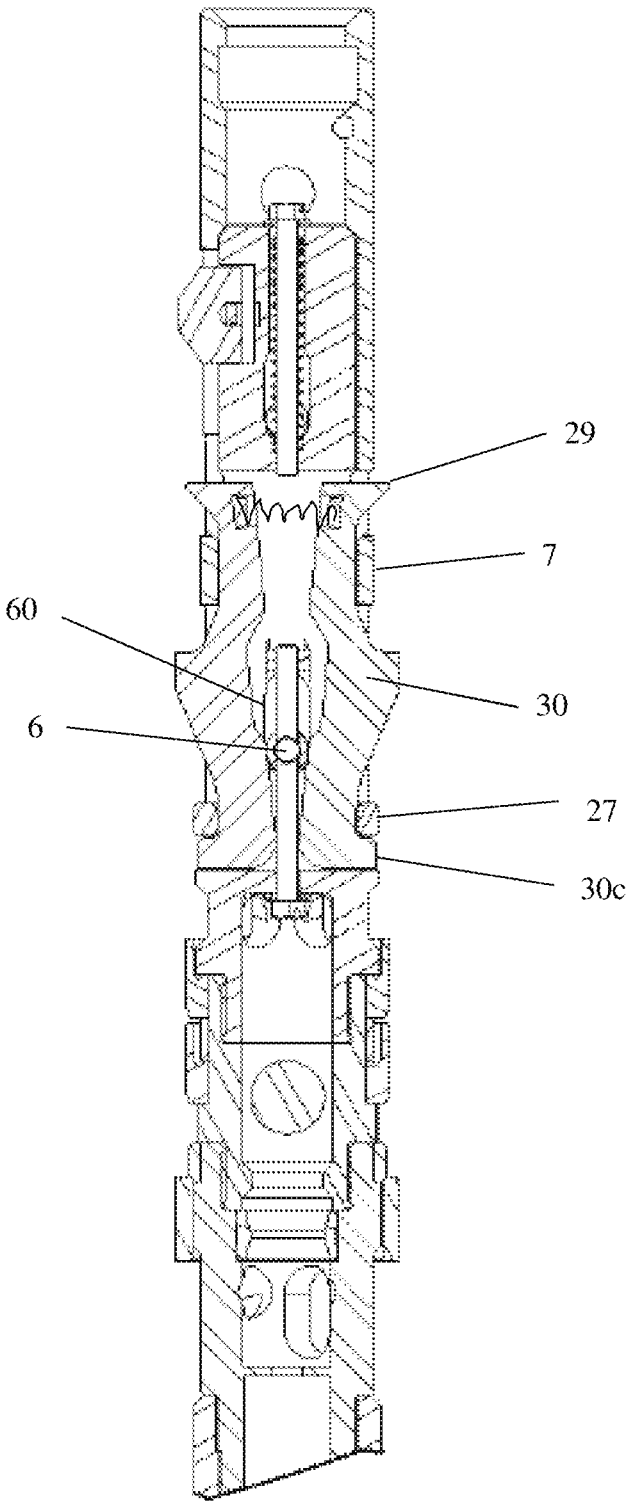
FIG. 16 represents a longitudinal cross-sectional view of the embodiment shown in FIG. 1 with the retracting case installed and the latches in the engaged position.

When the latches are installed, the retracting case is fully withdrawn to provide space for the latches to rotate, as shown in FIG. 14. After the latches are installed, the retracting case may be moved into position. Along these lines, FIG. 15 illustrates the retracting case in a partially installed position. FIG. 16 shows the retracting case installed and latches in an engaged position.

Figure 9:
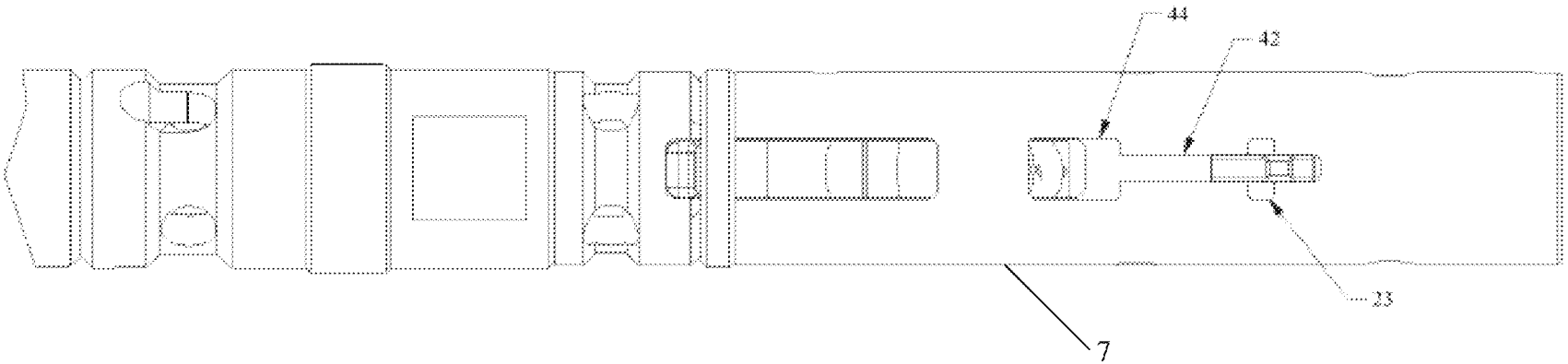
FIG. 9 represents an exterior view of the embodiment shown in FIG. 2 with the latches in the engaged position.
Figure 10:
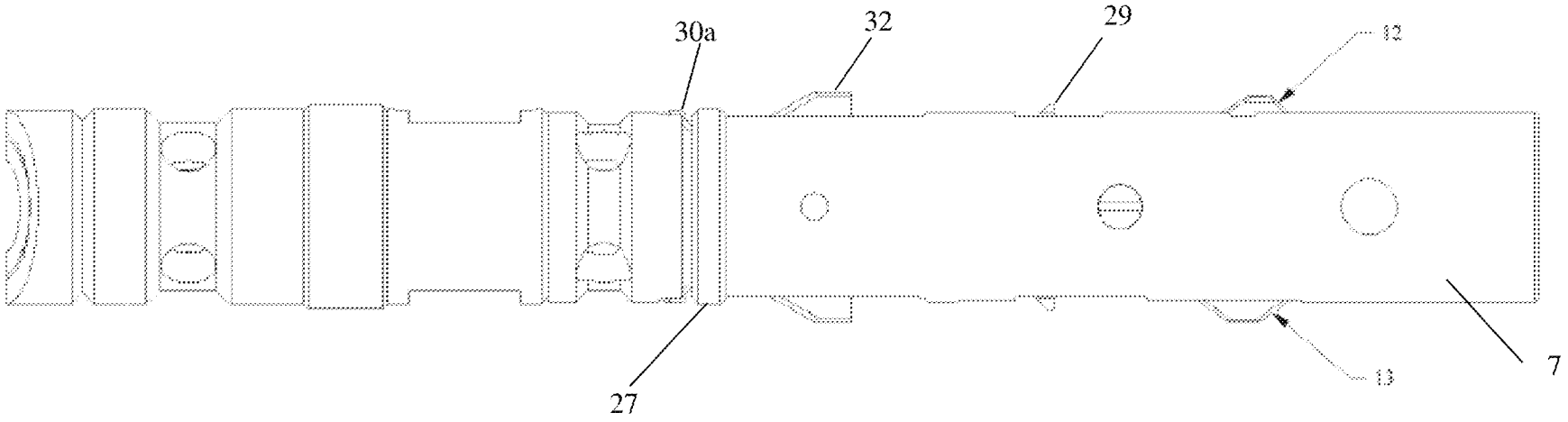
FIG. 10 represents an exterior view of the embodiment shown in FIG. 1 with the latches in the engaged position.
Figure 11:
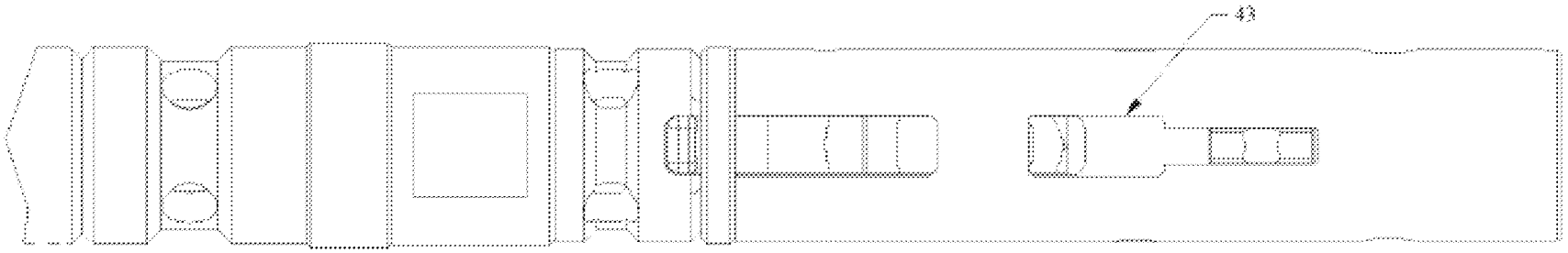
FIG. 11 represents an exterior view of the opposite side of the structure shown in FIG. 9.

FIGS. 6 and 7 illustrate the latches in engaged and retracted positions. FIGS. 9-11 also illustrate the latches in an engaged position from a point of view outside the core barrel assembly. Along these lines, FIGS. 9 and 11 depict the latches from opposite sides of the structure shown in FIG. 2 and FIG. 10 depicts the view shown in FIG. 1.

The retracting case 7 may house a number of components involved in retracting and extending the latches. For example, an action pin 10 may be installed in the retracting case. The action pin 10 may extend through a slot 33 in the upper body 35. The slot 33 and action pin 10 may limit movement of the upper body and retracting case 7 relative to each other. A spring bolt 34 may retain the retract spring 36. The spring bolt 34 may extend through a hole perpendicular to the longitudinal axis of the action pin 10. The spring bolt 34 may be connected to the upper body 35. For example, the spring bolt 34 and the upper body may include threaded connections. Other configurations of this assembly are also possible. For example, a grub screw may be utilized in place of the spring bolt. The grub screw will then hold the retract spring 36 in the upper body and apply force to a solid action pin 10. This may eliminate the hole in the action pin and threaded portion 35 of the upper body.

The upper body 35 acts on the latches during the retraction and extension of the latches. Along these lines, the retract spring may apply a force on the action pin to bias the retracting case to a lower position in which the latches are engaged.

Figure 8:
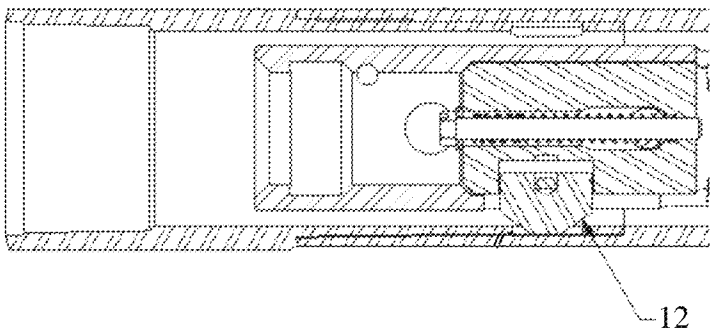
FIG. 8 represents a cross-sectional view of an embodiment of a drive key biased by a spring to engage a window in the outer tube.

The upper body 31 may include a pocket configured to receive a drive key 13. The drive key 13 may be biased by spring 39 to engage a window in the outer tube to ensure rotation of the head assembly, as shown in FIG. 8. The spring may be received by a spring passage 39*a* in the drive key 13. An end of the spring may be secured to the upper body 31 or to a pad attached upper body or inserted in a spring receiving passage in the upper body. The drive key may be inserted through a window 43 in the retracting case and may be held in place by a slot 41 in the retracting case 7.

Alternatively, the spring 39 may be a leaf spring and may be connected to the drive key or upper body. Any element that could bias the drive key could be utilized.

Figure 4:
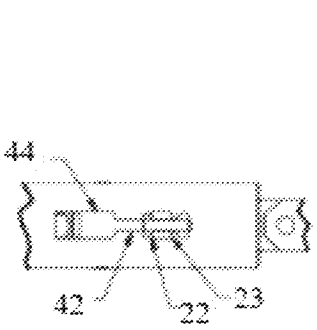
FIG. 4 represents a close-up view a pre-load key portion of the embodiment shown in FIG. 1.
Figure 5:
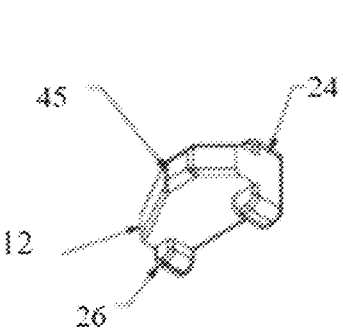
FIG. 5 represents a perspective view of the pre-load key portion shown in FIG. 4.

Similar to the drive key 13, the opposite side of the upper body 31 may include a pocket 38 configured to receive a pre-load key 12, as shown in FIGS. 4 and 5. The pre-load key 12 may be inserted through an opening 44 in the retracting case 7 and held in place by slot 42. The pre-load key 12 may be biased outwardly by spring 40. The pre-load key may include a retention tab 22, which is a portion of the pre-load key that remains within the inner surface of the retracting case to retain the pre-load key in the head assembly.

When the retracting case 7 is moved to a position in which the latches are retracted, the locking portion 24 of the pre-load key may extend into a window 23 in the retracting case while the retaining portion 26 of the pre-load key 12 may remain below the retracting case 7 to retain the pre-load key 12 in place. When the engaging surface 45 of the pre-load key is pushed inward, the locking portion 24 of the pre-load key 12 may be positioned the inner diameter of the retracting case 7, thereby permitting the retracting case 7 to move to the lower position.

The window 44 of the retracting case 7 that receives the pre-load key 12 may in a slightly different position on the retracting case 7 than the window 43 that receives the drive key such that the drive key will be held in place by slot 41 while the pre-load key is installed for easier assembly. The contact surface of window 23 may be hardened to prevent material deformation. The pre-load key 12 may retain the latches 5 in a retracted position so that inserting the core barrel assembly into the drill string can be done without the need for extra tools, such as a loading funnel, or the need to pull on the retracting case 7 while pushing in the assembly.

A receiver 14 of the retracting case 7 may engage with the overshot to pull the inner tube assembly back to the surface. The receiver may be operatively connected to the retracing case 7. To facilitate mobility and handling of the retracting case and inner tube while connected to the overshot, the receiving 14 may be pivotable. For example, the receiver 14 may be connected to a receiver base 46 at a pivot point with a pin. Similarly, the receiver base 46 may be connected to the retracting case 7 with a pin. This can permit the receiver to pivot about two axes. A detent plunger 47 may be spring loaded 48 inside the receiver 14. The detent plunger 47 may hold the receiver end 14 and receiver base at predetermined angles.

If the inner tube assembly is inserted into the drill string with the receiver 14 not aligned with the axis of the core barrel head assembly, the end of the drill rod may strike the receiver 14 and overcome the spring force of the detent spring and, thus, align the receiver 14 with the head assembly. The receiver 14 may have an outer diameter similar to the inner diameter of the outer tube. This may facilitate maintaining the receiver 14 sufficiently centralized within the inner tube to receive the overshot 300.

The receiver may include features configured to facilitate engagement of the core barrel head with an overshot. While the discussion herein relates to a particular overshot, the core barrel head may be utilized with any overshot. The receiver 14 of the core barrel might include various adaptations to facilitate connection to the overshot.

For example, the receiver 14 may include an internal cavity 62 configured to receive a body 50 of the overshot 300. Additionally, the receiver may include an internal passage extending at least partially therethrough. The internal passage may be contoured to include elements to engage elements of the overshot. For example, the internal passage of the receiver 14 may include an internal ledge 63 that is shaped to permit outwardly biased lifting dogs 53 of an overshot to hook onto.

Figure 26:
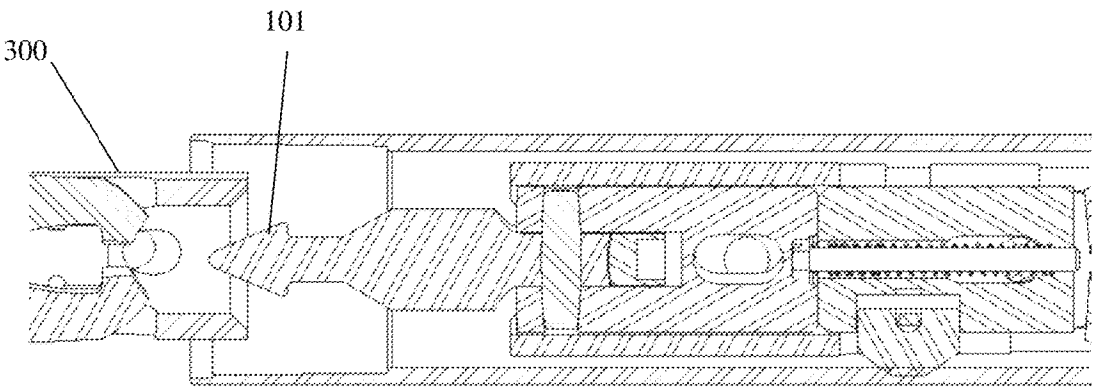
FIG. 26 represents a cross-sectional view an embodiment of a receiver structure according to an exemplary embodiment.

Some embodiments may include a receiver and retracting case combined in a single a rigid piece element, as shown in FIGS. 1 and 2. Such a structure may have a shorter overall length. Additionally, such a single piece element will not include the pivoting connections between the receiver and the retracting case discussed above. The one-piece retracting case and integrated receiving end may create a large area for an operator to push the core barrel assembly into an upwardly directed drill string, thereby eliminating the need to grip the circumference of the head assembly. According to some embodiments, the receiver may also be a spearhead assembly configured to accommodate existing retrieval equipment, as shown in FIG. 26.

Side end of the upper body opposite where the latches are attached may be connected to a mid-body. The mid body may connect the upper body to elements of a lower body. The configuration of the mid-body may vary, depending at least in part upon where the core barrel is being utilized. For example, mid-body 20 may be utilized in surface drilling, such as for down hole drilling. The surface mid-body may include a threaded connection to connect to a complementary threaded connection on the upper body 31. A lower body 64 may be attached to the mid-body opposite the upper body. The lower body may also be connected to the mid-body with a threaded connection.

Figure 3:
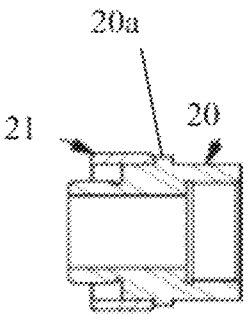
FIG. 3 represents a close-up longitudinal cross-sectional view a mid-body portion of the embodiment shown in FIG. 1.

The lower body may be configured to retain a landing shoulder 21 in place on the core barrel assembly. Along these lines, the exterior surface of the lower body may include one or more elements to engage the landing shoulder, such as flange 20*a* shown in FIG. 3. The landing shoulder may engage the inner tube to properly locate the inner tube with respect to the outer tube.

On the other hand, if the core barrel is being utilized in underground applications, the mid-body 18 may be configured as shown in FIG. 1. The underground embodiment of the mid-body 18, may be utilized when pumping in the inner tube assembly is required. The underground mid-body 18 may be interchangeable with the surface mid-body 20. Along these lines, the underground mid-body 18 and surface mid-body 20 may have the same or similar overall length and may include threaded connections to join to the upper body and lower body.

A portion of the outer surface of the underground mid-body 18 may have a reduced diameter to permit installation of propulsion seals 4 and a seal spacer 19 on the mid-body. The underground landing shoulder 18 may be shorter than the surface landing shoulder. As noted above, when drilling in an upward direction, seals may be required. Along these lines, one or more seals may be arranged about the mid-body. For example, two seals may be installed about the mid-body. A spacer 19 may be arranged between the seals. The length of the seals may exceed the length of the adapter coupling latch relief length. This may help to ensure that a certain pumping pressure may be maintained while the seals pass through the latch relief in the adapter coupling. The upper seal may overlap 61 the upper body to accommodate the length of the latch relief without increasing the length of the head assembly. The underground landing shoulder and seal overlap may permit an underground configured head assembly to have the same or substantially the same length and make it possible to utilize the same components as the surface configuration.

The side of the lower body 64 opposite the mid-body may be connected to an upper assembly 100 and a bearing assembly 200. Additionally, the lower body 64 may help to hold the landing shoulder 117 or 21, with the above ground or underground configuration, respectively, in place. The lower body may be configured to receive a standard ball and bushing valve 65.

The ball and bushing are a landing indicator. The ball typically is slightly larger than the bushing. The ball may be made of steel and the bushing of plastic. However, other materials may also be utilized. When the inner tube lands, the landing shoulder may create a seal with the landing ring of the outer tube. This may cause the fluid pressure to increase and may be indicated on the surface by gauges on the drill. The pressure may build until there is enough force to push the ball thru the bushing to allow water to flow for drilling.

The lower body 64 may include a cavity 3 that may house alternative valves and/or valve components. The cavity may additionally or alternatively house electronic devices. The electronic devices may include hole survey devices, core orientation devices, valve devices and/or other devices.

The lower body 64 may include a threaded connection on one end to connect to a complementary threaded connection on the bearing assembly spindle 2. The threaded connections may be internal or external. This threaded connection may be utilized to adjust the length of the inner tube assembly and may be locked in place by a lock nut 65.

As shown in FIGS. 1 and 2, a bearing assembly 200 may be connected to the lower body opposite the mid-body. The bearing assembly 200 permits the core barrel head assembly to rotate with the drill string while keeping the inner tube stationary when the core is being collected. The bearing assembly may include thrust bearings 16 and 17 that facilitate smooth rotation of the core barrel assembly. A radial bearing 15 may be mounted further away from the lower body of the spindle 2. The distance between the radial bearing 15 and the thrust bearings may be maximized to create a more stable assembly.

A spring 70 may be arranged about a portion of the lower body of the spindle. The spring may help to relieve at least a portion of the force needed to break the core sample from the rock formation. A grease port 71 may be arranged at an end of the lower body of the spindle. The grease port may provide an input for lubrication for the bearings inside the assembly and to seal the lubrication input.

The bearing assembly 200 may include valves configured to control flow of fluid into and out of the inner tube. For example, a check valve body 68 and valve ball 69 may be arranged at the base of the bearing assembly may permit pressure to be released inside the inner tube and may prevent fluid pressure from entering the inner tube. When the inner tube is full of the core sample, the core may push on the bearing assembly and compress the valves 67, which may also be arranged about the spindle. The valves may be made of a compressible material. The valves 67 may increase in diameter due to the compression until they engage the inside of the outer tube, cutting off the fluid flow. This may cause the fluid pressure to rise.

The pressure increase indicates that the inner tube is full and ready to be retrieved by the overshot. The pressure may be detected automatically by a sensor. Alternatively, an operator may detect the pressure increase by monitoring fluid pressure on a gauge.

The bearing assembly 200 may include an inner tube cap body 2 to connect the inner tube with the bearing housing of the bearing assembly 200. Additionally, the bearing assembly 200 may include a spindle 2, which is a shaft for the bearings to rotate. The spindle 2 may also permit adjustments to be made to the length of the head assembly 100.

As stated above, a withdrawing assembly is attached to the core barrel assembly to withdraw the core barrel when the core is obtained or anytime that it is desired to withdraw the core barrel assembly. A number of different retrieval mechanisms may be utilized. For example, a spearhead assembly or an overshot could be utilized. If an overshot is utilized, an embodiment of an overshot shown and described herein may be utilized or any other overshot construction. Similarly, embodiments of the overshot may be utilized with other core barrel assembly structures.

Embodiments of the overshot typically include a set of lifting dogs, release dogs and a locking dog. The lifting dogs, release dogs and/or locking dogs may include hocks and/or other structures configured to engage a portion of the core barrel assembly to facilitate engagement of the core barrel by the overshot to apply force to remove the core barrel and inner tube from a hole. For example, ends of the lifting arms 53 may include hooks to engage a portion of the core barrel assembly. The lifting dogs, release dogs and/or locking dogs may move between unlocked and locked positions. The locking dog may be biased to lock the release arms preventing them from activating the lifting dogs. The lifting dogs may be biased to engage a receiver on the core barrel head assembly. The lifting dogs may be disengaged by the release arms. After the locking dog is moved to the unlocked position, the release arms may be squeezed to activate the lifting dogs and disengage the overshot from the head assembly. Simultaneously, the release arms may release the locking dog from the unlocked position. When the release arms are released, the locking dog may move back to the locked position.

In more detail, the embodiment of the overshot 300 shown in the Figures may include a body 50. The body 50 of the overshot may have an outer diameter that is a slightly smaller than the inner diameter of the drill string. This may help to maintain the overshot centralized in the drill string.

The body 50 may include regions that permit fluid to flow around the body. This can facilitate faster travel of the body through the drill string. Along these lines, the body may include one or more flats 76 and/or grooves 75 around the outside.

The lifting dogs, release dogs and/or locking dogs may be mounted in and/or on the overshot body 50. Along these lines, the overshot body may include one or more slots 84 to house the lifting arms 53. Additionally, the lifting dogs, release dogs and/or locking dogs may be pivotably mounted on the overshot body. For example, the slots in which the lifting dogs are mounted may include a pivot point 78 for each lifting arm.

Similar to the latches, the lifting dogs, release dogs and/or locking dogs may be biased between two positions. For example, overshot may include a spring 81 to bias the lifting arms. The spring may be arranged in a spring receiving passage on the inner side of each arm. The spring 81 may force the hook end 54 of the lifting arms 53 outward to latch onto an internal groove 63 arranged on the internal surface of the receiving end of the head assembly. The spring may force the activation end 55 of the lifting arms 53 inward.

The lifting arms 53 may be centralized within the overshot body. This can facilitate engagement of the core barrel assembly by the overshot. For example, the overshot may include a centering pin 59. The centering pin 59 may keep the lifting dogs and release dogs aligned to the overshot body in all positions to ensure engagement with the head when the overshot is being connected on an angle and may ensure even rotation of the dogs when releasing the overshot from the head The overshot may also include a pair of release arms configured to disengage the lifting arms 53 from the core barrel. The release arms may pivot the lifting arms about their pivots to cause the lifting arms to disengage from the core barrel. The release arms may be pivotably mounted in the overshot. As each release arm pivots, it may cause one of the lifting arms to pivot in an opposite direction.

According to the embodiment shown in FIGS. 1 and 2, the slot 84 in the overshot may also house the release arms 52. The release arms 52 may each include a pivot pin 79. The release arms may be biased in a position to permit the lifting arms to remain engaged with the core barrel assembly. For example, the embodiment shown in FIGS. 1 and 2 includes a spring 82 to extend the release portion 85 of the release arms outwardly and the activation end 85*a*, opposite the release end, inward. A pin 90 may limit the pivot of the release arms and/or help to maintain the release arms centered as pin 59 does for the lifting arms 53.

The overshot may also include a locking unit configured to lock the lifting and/or release arms in a locked and/or unlocked position. For example, the embodiment shown in FIGS. 1 and 2 includes a locking dog 51. The locking dog may be pivotably attached to the overshot.

In the embodiment shown in FIGS. 1 and 2, a second slot 87 perpendicular to and rearward of the first slot 84 may house the locking dog. The locking dog is pivotably mounted in the second slot 87 such that the locking dog pivots at pivot 58. The pivot permits the locking dog to slide such that the pivot slides in the slot 80 in the locking dog. The body of the overshot may be connected to other portions of the overshot assembly utilizing a threaded hole 56. Alternatively, features for a pivoting connection or other type of connection to the overshot assembly may be integral to the body to reduce length and increase strength of the assembly.

The locking dog may be biased in a position to maintain the release arms from pivoting. To maintain the locking dog in this position, the overshot may include a spring 83 forces the activation end 88, or end to which force is applied to operate the locking dog, of the locking dog outward and forces the locking end 89, or the end of the locking dog that engages the release arms 52, inward to a position that may prevent the release arms from pivoting substantially.

The locking end of the locking dog engages an end of at least one of the release arms. In a first position, the locking end 89 of the locking dog may be arranged between the ends of the release arms below a catch surface 57 such that the locking dog prevents the release arms from pivoting. The lifting dog may include a hook end 54 that may move inward to connect to the head assembly even when the release arms are locked. The lifting dog may be within the slot of the main body with no protrusions other than the hook end. This may permit the lifting arms to move within the receiving end 62 of the core barrel head assembly and then be withdrawn from the receiving end so that the hooks on the lifting arms latch onto the internal groove 63 within the core barrel assembly. When the hooks of the lifting arms are engaged with the body of the receiving end of the head assembly, the hooks will be protected and prevented from moving toward each other.

With the hooks of the lifting arms engaged with the receiving end of the core barrel head assembly, the overshot will be locked onto the care barrel head assembly. Typically, the lifting arms will only be able to be released manually. To release the lifting arms, the locking dog activation end 88 may be moved toward the core barrel assembly and toward the longitudinal axis of the overshot so that the locking dog slides on slot 80 until the locking end 85 rests on the catch surface 57 of the release arm and is no longer positioned between the release arm 52. This is the unlocked position.

Moving the release ends 85 of the release arms inward toward each other causes the release arms to pivot about the pivot 79 and the release arm activation ends to move outward. As the release arm activation ends move outward, they act on the lifting dog activation ends 55, moving them outward. As the lifting dog activation ends 55 move outward, the lifting arms rotate about the pivot 78, which forces the lifting arm hook end 54 inward to release the lifting arm from the head assembly.

Squeezing the release arms together may also cause the release arms to act on the locking dog arming portion 89, causing the locking dog arming portion to slide off of the catch surface 57. With the locking dog arm in this position, the overshot is in the release position. When the release arms are no longer forced inward, spring 82 will cause the release arms to return to their normal, outward positions. Additionally, spring 82 will cause the locking dog to move in between the release arms so that the overshot will be in the normal, locked position. Alternatively, the lifting dogs and release dogs may be configured and biased to grip onto a spearhead of a head assembly.

The body of the overshot 50 typically has minimal clearance inside the receiving end 62 of the head assembly to ensure proper alignment and engagement of the lifting arms 53 and ledge 63. The angles of the lifting arm hook end and receiving end ledge may be the same or substantially similar. However, it may be that the angles differ but extend in generally similar directions so that the hook may engage the ledge and maintain the lifting arms in place. Also, the angle may be such that when a force is applied to separate the head assembly from the overshot, the lifting arm hooks are forced deeper into the ledge.

Figure 25:
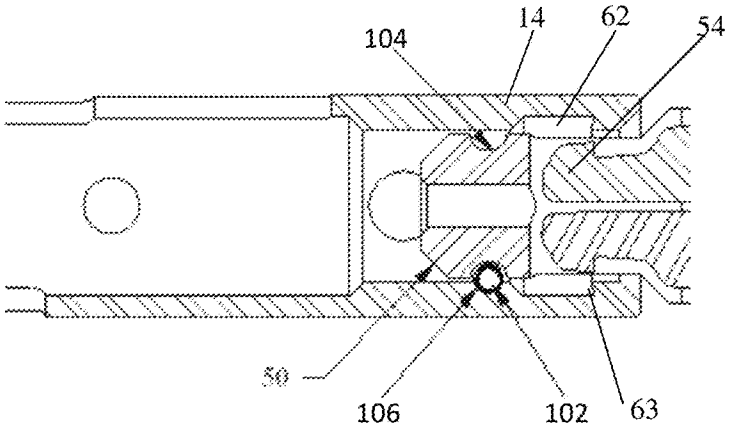
FIG. 25 represents a cross-sectional view an embodiment of a receiver structure including a spearhead assembly configured to accommodate known retrieval equipment.

The pivots for the lifting arms may be spaced outward with respect the central axis of the overshot. Additionally, the contact distance between the receiver end ledge may be such that when a force is applied to separate them, it would cause the lifting arm hook end further into the receiver groove 63. Alternatively, the slot 80 of the locking dog may be a slot in the overshot body. A removable pin 100 may be arranged between the lifting arms and the head assembly to prevent them from separating in the event of complete lifting dog failure as an extra safety device, as shown in FIG. 25. To accommodate the pin 102, the overshot includes a groove 104 and the retracing case includes a hole 106. Alternatively, the biasing springs can be torsion springs so as to be able to apply greater force. A hole 56 may be an integral component to flexibly connect to a sinking bar or jar staff.

Figure 24:
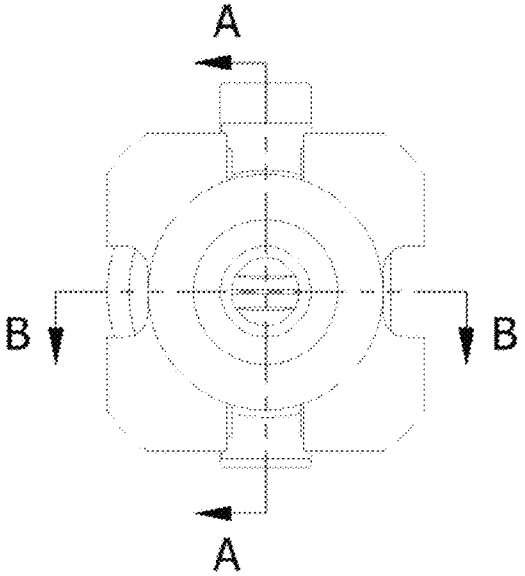
FIG. 24 represents a transverse cross-sectional view of the embodiment of the overshot shown in FIGS. 18-23 illustrating relative points of view of the cross-sections shown in FIGS. 18-20 and 21-23.

FIGS. 18-23 illustrate the embodiment of the overshot shown in FIGS. 1 and 2 in various stages of engaging a core barrel head assembly as well as illustrating the embodiment of the overshot from various angles the orientation of which is shown in FIG. 24.

Embodiments of the core barrel head assembly and overshot may have one or more associated advantages over known structures. Advantages of the core barrel do not necessarily depend upon utilizing the head assembly with the overshot and vice versa. However, there may be some advantages to utilizing the core barrel head assembly with the overshot.

With respect to the head assembly, as described above, in some instances, when utilizing any core barrel head assembly device, the latches may not disengage and the core barrel assembly may become stuck. At least in part due to the relative positions of the release, outer tube engaging surface and pivot and hook, the core barrel typically has an associated mechanical advantage in with respect to opening the latches. This can reduce or eliminate problems with disengaging latches of a jammed inner tube assembly.

Along these lines, known latch designs typically have a releasing force applied between the pivot point and latching surface. This results in a mechanical disadvantage of about 0.2× when the wire line is pulled to unlatch the head assembly. Typically, the force required to unlatch a jammed inner tube is higher than the breaking strength of the typical wire line or capacity of the wireline hoist.

Some known latch designs have a high mechanical advantage of about 3.5×. The mechanical advantage results in a force on the wire line to release a jammed inner tube less than the breaking strength of the wire. However, the high leverage is applied under normal drilling conditions and puts excessive force on the latches and linkages causing premature wear and other types of failure modes.

Embodiments of the latches may have a releasing force that is applied beyond the latching surface to provide a higher leverage ratio, such as on the order of about 2×, to unlatch. The latches may have a pivot point that is more underneath the latching surface than known designs. This may reduce interference with the latching surface when unlatching. These features may be combined to reduce the required pulling force needed on the wire line to release a jammed inner tube. This force typically is less than the ultimate breaking strength of the typical wire line or wireline hoist capacity and permits a jammed inner tube to be unlatched.

Additionally, embodiments of the latches may provide a more simple design than known latch designs. Along these lines, each latch may be a solid, one piece element. Such design will be simpler to construct and install. Additionally, the latch design may be durable and less prone to premature wear or breakage during handle on the surface.

Embodiments of the latches may be biased to engage the locking coupling at all times. However, the latches may be held in a disengaged position by engaging a groove on the retracting case, thereby holding the retracting case in the retracted position. The force of the inner tube assembly landing at the bottom of the drill string may disengage the latches from the groove so that they can extend and engage the locking coupling. This may reduce or eliminate the speed reducing drag of the latches on the drill string as it travels into the hole.

In embodiments of the latches that include the bridged slot and hook and pivot, the hook will extend under the bridge when the latches are installed. As described above, the hooks of the latches can be inserted into the body when they are close to perpendicular to the latch body axis. Rotating the latches so that they are more in line with the body will lock them in place due to the wider portion of the hook at this angle. The retracting case will hold the latches at angle that will hold them in the latch body. This eliminates the need for spring pins which can fail without notice.

All parts in the upper assembly of the core barrel may be held in place by the retracting case. The retracting case may be held in place by the sliding pins. The sliding pins may be held in place by at least one assembly rod. By removing the assembly rod, the upper assembly may be completely disassembled. As illustrated in the drawings, one assembly rod may be utilized to hold one sliding pin. Alternatively, two assembly rods may hold two sliding pins or one assembly rod could hold two sliding pins, for example.

The locking coupling of the latches may have a flat locking surface and rotate the head assembly with a separate drive key. This may reduce wear on the latches and also help to ensure the latches will engage the locking surface and not a drive key protruding from the locking surface. The drive key 13 may be housed in a drive key pocket 37. The drive key pocket 37 may be a cavity in the upper body.

The receiving end of the head assembly may have a cylindrical shape with a flat end. This can be comfortably pushed on by an operator's the palm to insert the inner tube into the drill string of an up hole. This shape is also safer for the operator in the case of an uncontrolled head assembly exits the drill string causing less harm.

Because the diameter of the cylindrical receiving end of the head assembly may be similar to the inside diameter of the outer tube, the opening to accept the overshot may be automatically centralized. Any failure of a centralizing mechanism will not cause the overshot to fail to connect to the head assembly.

Additionally, configurations of the core barrel for use when drilling underground may have a shorter landing shoulder and include seals that overlap the upper body. This may help to keep the length the same in all configurations and may not require different outer tube parts. Because the seals may not be mounted on the retracting case, there may be no concern of back pressure release.

The embodiments of the pre-load key may maintain the latches in a retracted position until the key is inserted into the drill string. Only then will the latches be allowed to extend and once latched to the locking coupling the latch lock will engage. This may eliminate the need for extra parts or difficult procedures to insert the core barrel assembly into a drill string.

Furthermore, embodiments of the latch lock may be independent of the latch position. The latches may be biased in the engaged position while the latch lock is in a disengaged position. The latch lock may be released while the latches are in a disengaged position and may only lock the latches when the latches move to an engaged position. The latch lock may remain disengaged until the care barrel assembly is inserted into the drill string.

An advantage of embodiments of the overshot is that the engagement with the overshot typically is not a dangerous spearhead point and may be self-centralizing inside the drill string. The overshot may remain in a locked position but can still engage with the head assembly and may automatically return to the locked position after manually unlocking and releasing the head assembly.

Also, the overshot may be locked in a normal position and may be able to connect to the head assembly while locked. Disconnecting the overshot from the head may simultaneously reactivate the lock. There may be no need to stop connecting and/or disconnecting the overshot to manually engage the lock. There may be no need to stop retrieval of the overshot and head assembly to manually engage the lock. Additionally, there may be no need to lift weight off of the overshot to disconnect it from the head assembly. Furthermore, there may be no chance for the overshot to accidentally lockout before it has a chance to connect with the head assembly.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

The invention claimed is:

1. A core barrel head assembly, comprising:

an upper body comprising a central passage;

a pair of latches arranged in the central passage, wherein each latch comprises a hook at a first end and a pivot point on an outside surface in the hook, wherein the hook of each latch extends through a hook slot such that the latches rotate about the pivot point and each latch pivoting about the pivot point at the first end, each latch comprising a latch release at a second end and an outer tube surface engaging surface between the first end and the second end;

a retracting case including a first end configured to engage at least the latch release of the latches; and wherein the outer tube surface engaging surface of each latch extends through a latch slot in an outer wall of the upper body and such that the latches rotate about the pivot point, and wherein the latches are movable between an extended position and retracted position by the retracting case with a mechanical advantage.

2. The core barrel head assembly according to claim 1, further comprising:

a spring configured to bias the latches in an open position.

3. The core barrel head assembly according to claim 1, wherein a bridge in the outer wall of the upper body separates the latch slot from the hook slot, such that each latch rotates about the bridge as the latch pivots about the pivot point.

4. The core barrel head assembly according to claim 1, further comprising:

a latch pin slot defined by portions of facing surfaces of the latches, the latch pin slot comprising a locking surface;

a locking pin slot on the upper body; and a locking pin extending through the locking pin slot and the latch pin slot, wherein when the latches are in the open position the locking pin locks the latches in the open position by engaging the locking surface.

5. The core barrel head assembly according to claim 1, further comprising:

an action pin extending through an action pin slot in the upper body, wherein the action pin slot is perpendicular to a longitudinal axis of the upper body;

a spring bolt comprising a head and extending through a spring bolt slot extending through the action pin and parallel to the longitudinal axis of the upper body, an end of the spring bolt being threadedly connected to the upper body; and a retract spring surrounding the spring bolt and extending between the head of the spring bolt and the threaded connection between the spring bolt and the upper body, wherein the spring acts on the action pin to bias the retracting case in a position in which the latches are in the engaged position.

6. The core barrel head assembly according to claim 1, further comprising:

an action pin extending through an action pin slot in the upper body, wherein the action pin slot is perpendicular to a longitudinal axis of the upper body;

a retract spring extending through a spring slot in the upper body; and a screw configured to retain the retract spring in the spring in the spring slot and engage the action pin.

7. The core barrel head assembly according to claim 1, wherein the upper body further comprises a pocket, the core barrel head assembly further comprising:

a drive key configured to engage a surface on the retracting case; and a spring configured to bias the key drive to engage a window in an outer be to facilitate rotation of the head assembly.

8. The core barrel head assembly according to claim 1, wherein the retracting case comprises a second end configured to receive an overshot assembly for retrieving the core barrel assembly.

9. The core barrel head assembly according to claim 1, further comprising:

at least one seal configured to seal between the core barrel head assembly and an outer tube of a drill string.

10. The core barrel head assembly according to claim 1, wherein the upper body further comprises a pocket, the core barrel head assembly further comprising:

a preload key configured to engage a surface on the retracting case; and a spring configured to bias the key to engage a window in the retracting case to maintain the latch lock in the disengaged position, wherein upon inserting the inner tube assembly into the drill string, the inner surface on the drill string will disengage the preload key from the retracting case and allow the latch lock to engage with the latches.

11. The core barrel head assembly according to claim 1, further comprising:

a bearing assembly, wherein the lower latch body comprises an external threaded connection to the bearing assembly, and wherein the lower latch body comprises a space configured to house at least of at least one valve, at least one electronic device or core orientation device.

12. The core barrel head assembly according to claim 11, wherein the at least one electronic device is for a valve or hole survey.

13. The core barrel head assembly according to claim 1, further comprising:

at least one assembly rod, wherein upon removal of the at least one assembly rod, the head assembly can be completely disassembled without requiring additional tools.

14. The core barrel head assembly according to claim 1, wherein the core barrel head assembly is held together without a roll pin, a spring pin, a spiral pin, a dowel pin or other pin that relies on interference fit or deformation to maintain the components onto the assembly.

15. The core barrel head assembly according to claim 1, further comprising:

at least one pin configured to pivotably connect the latches to the head assembly.

16. The core barrel head assembly according to claim 15, wherein the pin comprises a roll pin or a spring pin.

17. The core barrel head assembly according to claim 1, further comprising:

an overshot for retrieving a core barrel inner tube assembly from a drill string.

18. A method in earth drilling, the method comprising:

providing a core head barrel comprising an upper body comprising a central passage, a pair of latches arranged in the central passage, wherein each latch comprises a hook at a first end and a pivot point on an outside surface in the hook, and wherein the hook of each latch extends through a hook slot such that the latches rotate about the pivot point and each latch pivoting about the pivot point at the first end, each latch comprising a latch release at a second end and an outer tube surface engaging surface between the first end and the second end, a retracting case including a first end configured to engage at least the latch release of the latches, and inserting each latch through a slot in the upper body such that the hook extends around a bridge in the upper body; and rotating the latches about the pivot, thereby bringing the second end of the latches toward the core barrel head assembly wherein the outer tube surface engaging surface of each latch extends through a latch slot in an outer wall of the upper body and such that the latches rotate about the pivot point, and wherein the latches are movable between an extended position and retracted position by the retracting case with a mechanical advantage;

engaging the core barrel head assembly with an overshot; and removing the core barrel head assembly from a hole.

* * * * *